US006926173B1

(12) United States Patent
McGlothlin et al.

(10) Patent No.: US 6,926,173 B1
(45) Date of Patent: Aug. 9, 2005

(54) DISPOSABLE CONDIMENT SHAKER AND DECORATIVE SLEEVE

(75) Inventors: W. Lyle McGlothlin, Danville, KY (US); W. Richard Oetgen, Savannah, GA (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 10/765,786

(22) Filed: Jan. 27, 2004

(51) Int. Cl.[7] ..... B67D 5/06

(52) U.S. Cl. ..... 222/183; 222/1; 222/142.1; 222/142.3; 222/142.5; 222/565; 220/253

(58) Field of Search ..... 222/183, 144, 222/142.1, 131, 142.3, 142.5, 142.4, 142.6, 222/562–565; 220/258.1, 669–671

(56) References Cited

U.S. PATENT DOCUMENTS 553,580 A * 1/1896 Frye ..... 222/142.1
2,182,623 A * 12/1939 Dolar ..... 222/142.3
2,361,047 A * 10/1944 Morey ..... 222/553
2,601,061 A * 6/1952 Schwartz ..... 222/162
4,961,521 A * 10/1990 Eckman ..... 222/142.5
6,283,339 B1 * 9/2001 Morrow ..... 222/452

* cited by examiner

*Primary Examiner*—Frederick C. Nicolas
(74) *Attorney, Agent, or Firm*—IPLM Group, P.A.

(57) ABSTRACT

A disposable, tamper-resistant condiment shaker (10) containing a condiment (37) is supported within a cavity (24) of a decorative sleeve (20) to provide a more aesthetically pleasing condiment dispensing assembly (100). The sleeve (20) includes a securing member (29, 42, 44) to support the shaker (10) within the cavity (24). When the condiment supply within the shaker (10) has become depleted, the shaker (10) may be removed from the sleeve (20), discarded, and replaced with a new shaker (10). This cartridge type loading and refilling of the condiment (37) eliminates the need to pour condiment (37) into a dispenser.

17 Claims, 4 Drawing Sheets

DISPOSABLE CONDIMENT SHAKER AND DECORATIVE SLEEVE

BACKGROUND OF THE INVENTION

1. Field of the Invention

The present invention relates to a condiment dispensing assembly, more particularly, a disposable condiment shaker and a decorative sleeve for use with the disposable condiment shaker.

2. Description of the Prior Art

Condiment shakers are typically located at each table in eating establishments. There are various types of condiment shakers, which generally include refillable condiment shakers and disposable condiment shakers. Many eating establishments use refillable condiment shakers because once the shakers are purchased they are relatively inexpensive to refill and they are typically more decorative and appear more expensive than disposable condiment shakers. A drawback to using refillable condiment shakers is that they may be opened at the table thus providing an opportunity for tampering or adulteration of the contents. In addition, there is an opportunity to accidentally fill the shaker with the wrong condiment. To help eliminate these concerns, disposable, tamper-resistant condiment shakers may be used, but these are not typically used in more up-scale restaurants because they may appear to be inexpensive relative to the refillable condiment shakers. Therefore, there is a need to provide an affordable, disposable, tamper-resistant condiment shaker that looks aesthetically pleasing on the table.

SUMMARY OF THE INVENTION

A preferred embodiment sleeve is configured and arranged for use with a disposable, tamper-resistant condiment shaker. The condiment shaker includes a top, a wall portion, and an end portion. The wall portion has a first end and a second end, the top is operatively connected to and encloses the first end, and the end portion is operatively connected to and encloses the second end. The end portion includes a ledge proximate the wall portion, and the wall portion interconnects and is integral with the top and the end portion thereby preventing the condiment shaker from being opened. The sleeve includes a top portion, a bottom portion, and an intermediate portion. The top portion includes a first opening, which is configured and arranged to provide access to at least a portion of the top of the condiment shaker. The bottom portion includes a second opening through which the condiment shaker may be inserted. The intermediate portion interconnects the top portion and the bottom portion and includes an inner surface. The inner surface includes a raised member proximate the bottom portion, and the intermediate portion is configured and arranged to house the condiment shaker. A cavity is formed by the top portion, the bottom portion, and the intermediate portion, and the first opening and the second opening provide access to the cavity. The cavity is configured and arranged to receive the condiment shaker, wherein the top of the condiment shaker is inserted into the second opening, the condiment shaker is pushed through the second opening into the cavity, the ledge is slid past the raised member thereby providing a snap-fit between the condiment shaker and the sleeve. The first opening provides access to at least a portion of the top of the condiment shaker.

A preferred embodiment condiment dispensing assembly includes a shaker and a sleeve. The shaker includes a top, a wall portion, and an end portion. The wall portion has a first end and a second end. The top is operatively connected to and encloses the first end. The end portion is operatively connected to and encloses the second end. The wall portion interconnects and is integral with the top and the end portion thereby preventing the shaker from being opened and being tamper-resistant. The sleeve includes a top portion, a bottom portion, an intermediate portion, a cavity, and a securing member. The top portion includes a first opening, which is configured and arranged to provide access to at least a portion of the top of the condiment shaker. The bottom portion includes a second opening through which the condiment shaker is inserted. The intermediate portion interconnects the top portion and the bottom portion and is configured and arranged to house the shaker. The cavity is formed by the top portion, the bottom portion, and the intermediate portion. The first opening and the second opening provide access to the cavity, and the cavity is configured and arranged to receive the shaker. The securing member is operatively connected to the intermediate portion, wherein the top of the shaker is inserted into the second opening, the shaker is pushed through the second opening into the cavity, the securing member supports the shaker within the cavity of the sleeve, the first opening provides access to the at least a portion of the top of the condiment shaker.

A preferred embodiment method of using a sleeve to decorate a condiment shaker includes obtaining a disposable, tamper-resistant condiment shaker containing a condiment. The condiment shaker includes a top, a wall portion, and an end portion forming a first cavity. The condiment is contained within the first cavity. The wall portion has a first end and a second end. The top is operatively connected to and encloses the first end, and the end portion is operatively connected to and encloses the second end. The end portion includes a ledge proximate the wall portion, and the wall portion interconnects and is integral with the top and the end portion thereby preventing the condiment shaker from being opened. A sleeve including a top portion, a bottom portion, an intermediate portion, and a second cavity is obtained. The top portion includes a first opening, and the first opening is configured and arranged to provide access to at least a portion of the top of the condiment shaker. The bottom portion includes a second opening through which the condiment shaker may be inserted. The intermediate portion interconnects the top portion and the bottom portion and includes an inner surface. The inner surface includes a raised member proximate the bottom portion. The intermediate portion is configured and arranged to house the condiment shaker. The second cavity is formed by the top portion, the bottom portion, and the intermediate portion. The first opening and the second opening provide access to the second cavity, and the second cavity is configured and arranged to receive the condiment shaker. The top of the condiment shaker is inserted into the second opening. The condiment shaker is pushed through the second opening into the second cavity, wherein the ledge is slid past the raised member thereby providing a snap-fit between the condiment shaker and the sleeve. The first opening provides access to the at least a portion of the top of the condiment shaker.

DETAILED DESCRIPTION OF A PREFERRED EMBODIMENT

Figure 1:
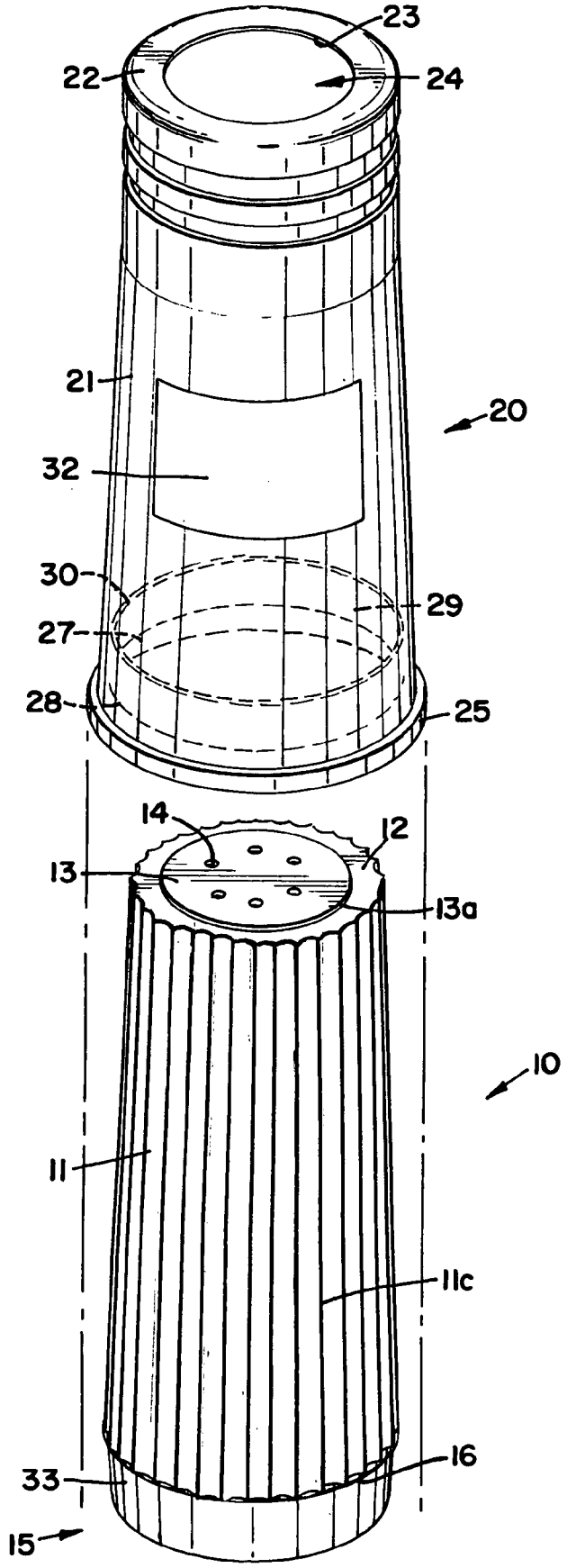
FIG. 1 is an exploded top perspective view of a condiment dispensing assembly constructed according to the principles of the present invention.
Figure 2:
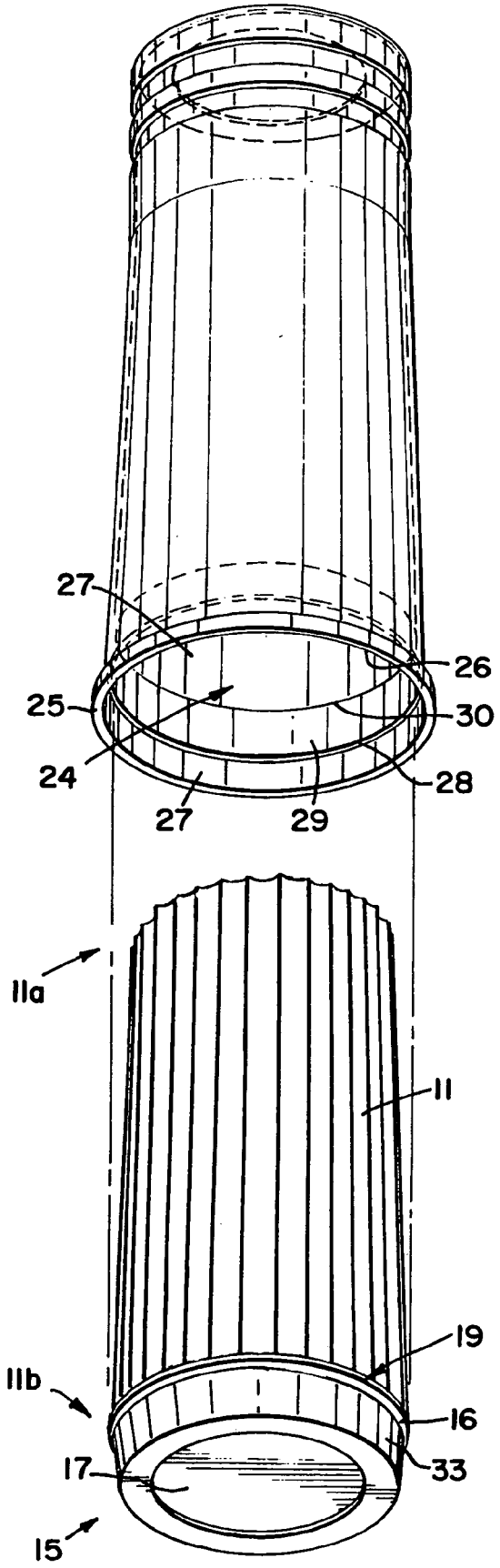
FIG. 2 is an exploded bottom perspective view of the condiment dispensing assembly shown in FIG. 1.

A preferred embodiment condiment dispensing assembly constructed according to the principles of the present invention is represented by the numeral 100 and includes a disposable condiment shaker and a decorative sleeve for use with the disposable condiment shaker, which are represented by the numerals 10 and 20, respectively, in the drawings.

The preferred disposable condiment shaker 10, shown in FIGS. 1–3A, is well known in the art. An example of a disposable condiment shaker that may be used is Classic Shakers manufactured by Diamond Crystal Brands, Inc. in Savannah, Ga. Although this type of condiment shaker is shown and described, it is recognized that other suitable types of shakers or dispensers may be used. The shaker 10 includes a wall portion 11, a top 12, and an end portion 15. The wall portion 11 is preferably a generally frustum shaped portion having a smaller diameter proximate a first end 11*a*, which is proximate the top 12, and a larger diameter proximate a second end 11*b*, which is proximate the end portion 15. The wall portion 11 may also include ribs 11*c* extending vertically along the wall portion 11 to provide a grippable, non-slip surface. Although the preferred embodiment shaker has a wall portion that is tapered toward the top, it is recognized that a generally cylindrical wall portion may be used. In addition, the shape of the wall portion may be circular, square, triangular, and any other suitable shape.

The top 12 is preferably a circular shaped disk member having a diameter approximately equal to a diameter of the first end 11*a*, and the top 12 is configured and arranged to cover the first end 11*a* of the wall portion 11. The wall portion 11 and the top 12 are preferably molded as one integral piece. The top 12 preferably includes a raised portion 13 having apertures 14. The raised portion 13 is preferably circular and has a diameter 13*a* smaller than the diameter of the top 12. Although the raised portion 13 is shown being circular, any suitable shape may be used.

The end portion 15 includes a cylindrical portion 33 and a bottom 17, which are preferably molded as one integral piece. The cylindrical portion 33 includes a ledge 16 having a top edge 19, which is proximate the top of the cylindrical portion 33 and is generally circular shaped. The top edge 19 is configured and arranged to operatively connect to the second end 11*b* of the wall portion 11. The bottom 17 is preferably a circular shaped disk member having a diameter approximately equal to a diameter of the cylindrical portion 33 and is operatively connected thereto. The end portion 15 is configured and arranged to cover the second end 11*b* of the wall portion 11 and is preferably sonically welded to the second end 11*b*. The end portion is preferably made of a transparent material to provide a window through which to view the inside of the shaker 10.

The wall portion 11, the top 12, and the end portion 15 define a cavity 18 in which a condiment 37 is contained. The condiment 37 may be any suitable product well known in the art such as, but not limited to, sweetener, salt, and pepper. Because the components of the shaker 10 are preferably operatively connected to form an integral, one piece shaker 10, the shaker 10 may not be opened to refill the shaker with the condiment 37. The integral, one piece shaker 10 is therefore tamper-resistant because the only openings into the shaker 10 are the apertures 14 through which the condiment 37 is dispensed. It is recognized that any suitable arrangement of the apertures 14 may be used as long as the apertures 14 are configured and arranged to allow the condiment 37 to be readily dispensed from the shaker 10. Once the condiment 37 supply within the shaker 10 has been depleted, the shaker 10 may be discarded and replaced with a new shaker 10 containing condiment 37.

The preferred decorative sleeve 20, shown in FIGS. 1–3A, includes an intermediate portion 21, a top portion 22, and a bottom portion 25, which are preferably molded as one integral piece and may be made of any suitable material known in the art such as, but not limited to, plastic or metal. The sleeve 20 may also include an optional label 32 on the outer surface of the intermediate portion 21. The label 32 may include the name of the condiment, advertising, a logo, or other print. The intermediate portion 21 is preferably a generally frustum shaped portion having a smaller diameter proximate the top portion 22 and a larger diameter proximate the bottom portion 25. The intermediate portion 21 is configured and arranged to house the shaker 10. Again, although the preferred embodiment intermediate portion 21 is tapered toward the top, it is recognized that a generally cylindrical wall portion may be used. The intermediate portion 21 must only be configured and arranged to house the shaker 10, and the intermediate portion 21 may be any suitable shape as long as the shaker 10 may be housed therein.

The top portion 22 is preferably a flange extending inward from the intermediate portion 21 and forming an opening 23, which is preferably circular and slightly larger than the diameter 13*a* to receive and accommodate the raised portion 13 of the top 12 of the shaker 10. The opening 23 provides access to at least a portion of the top 12 of the shaker 10. The opening 23 need not be circular, and it is recognized that opening 23 may be configured and arranged to accommodate any shape and/or size of the raised portion 13. When the shaker 10 and the sleeve 20 are assembled, the raised portion 13 extends into the opening 23 and is preferably on the same plane as the top portion 22 to give the appearance that the shaker 10 and the sleeve 20 are a single unit. The bottom portion 25 forms an opening 26 through which the shaker 10 is inserted and provides a support surface upon which the sleeve 20 is placed on a tabletop or similar surface. The openings 23 and 26 provide access to the cavity 24, in which the shaker 10 is housed.

Figure 3A:
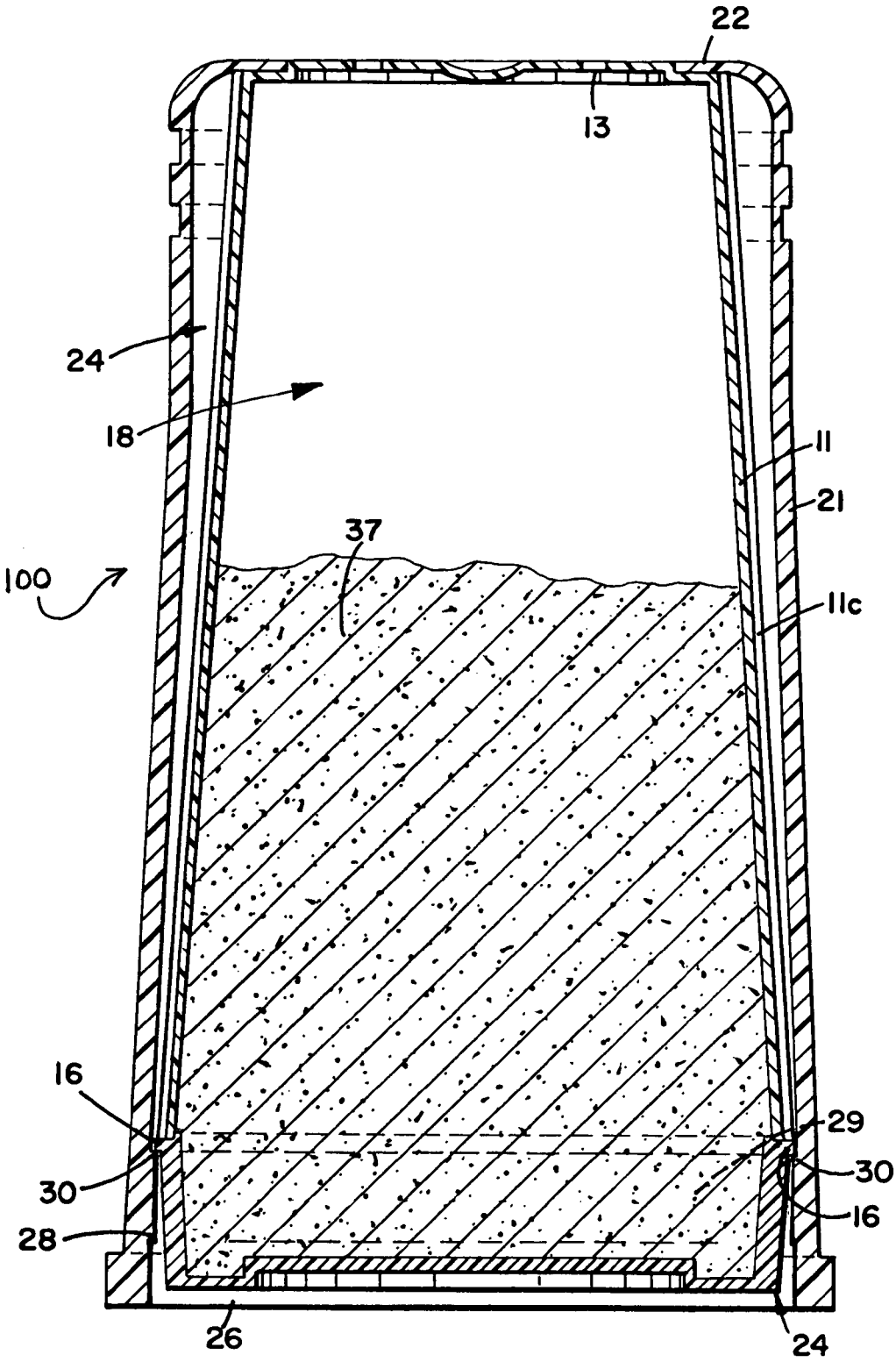
FIG. 3A is a cross-sectional view of the condiment dispensing assembly shown in FIG. 1.
Figure 3B:
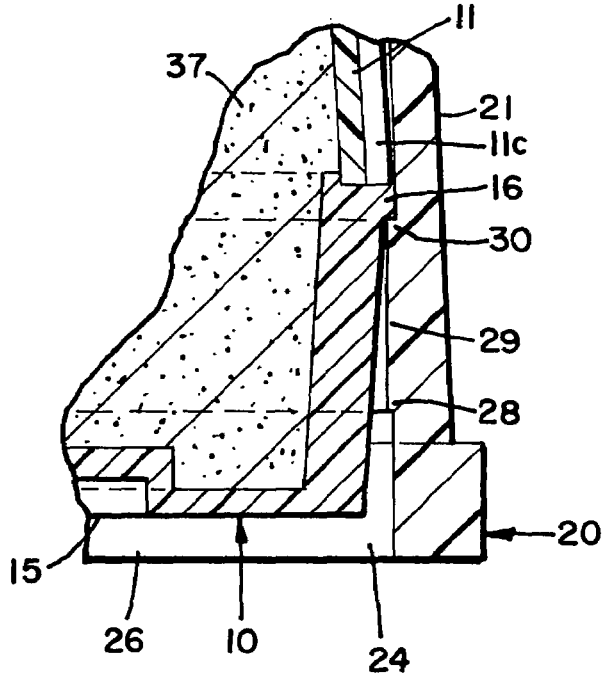
FIG. 3B is an enlarged partial cross-sectional view of the condiment dispensing assembly shown in FIG. 3.

The sleeve 20 also includes a securing member to support the shaker 10 within the cavity 24. The securing member is preferably operatively connected to the intermediate portion 21 of the sleeve. The preferred sleeve 20 includes an inner surface 27 having a raised member 29 proximate the bottom portion 25 of the sleeve 20, as shown in FIG. 3B. The raised member 29 extends from the inner surface 27 into the cavity 24 and includes a first ledge 28 and a second ledge 30. The first ledge 28 is proximate the bottom of the raised member 29 and the second ledge 30 is proximate the top of the raised member 29. The second ledge 30 is configured and arranged to be at an approximate height of the ledge 16 of the shaker 10 when the shaker 10 and the sleeve 20 are assembled. Because the shape of the sleeve 20 tapers inward from bottom to top, the first ledge 28 preferably has a slightly larger diameter than the second ledge 30. Therefore, the second ledge 30 of the raised member 29 provides a snap-fit for the ledge 16 of the shaker 10.

The height of the raised member 29, the distance between the first ledge 28 and the second ledge 30, is preferably approximately ⅝ inch in the embodiment shown in FIG. 3B. However, it is recognized that this distance may be varied. For example, when used with the shaker 10, the location of the first ledge 28 may be raised or lowered with respect to the second ledge 30 thereby varying the height of the raised member 29. The second ledge 30 is preferably not raised or lowered because then it may not provide adequate support for the ledge 16 of the shaker 10 to hold the shaker 10 in the desired position within the sleeve 20. More preferably, the distance may be approximately 3/16 inch or less to allow the shaker 10 to be more easily released from the sleeve 20 when pressure is applied upon the raised portion 13 of the shaker 10 to overcome the raised member 29 of the sleeve. The less friction between the ledge 16 and the raised member 29, the easier it will be to expel and replace the shaker 10 within the sleeve 20. However, there must be enough friction between the ledge 16 and the raised member 29 to sufficiently secure the shaker 10 within the sleeve 20.

In operation, a sleeve 20 and a shaker 10 containing condiment 37 are obtained. The top 12 of the shaker 10 is inserted into the opening 26 proximate the bottom portion 25 of the sleeve 20, and the shaker 10 is slid into the cavity 24 of the sleeve. When the ledge 16 of the shaker 10 is proximate the raised member 29 of the sleeve 20, the ledge 16 must overcome a frictional fit with the raised member 29. As the ledge 16 approaches and then slides past the second ledge 30, the shaker 10 snaps into place within the cavity 24 and the raised portion 13 of the shaker 10 extends through the opening 23 of the sleeve 20. The snap-fit is due to the ledge 16 having a slightly larger diameter than the second ledge 30 but a smaller diameter than the inner surface 27 above the second ledge 30. When the ledge 16 overcomes the second ledge 30, it "snaps" into place within the cavity 24. The top 12 around the raised portion 13 remains within the cavity 24. The shaker 10 is held in place within the cavity 24 of the sleeve 20 by the second ledge 30 of the raised member 29 supporting the ledge 16 of the shaker 10. When the condiment 37 has been depleted, the shaker 10 may be removed from the sleeve 20 by holding the sleeve 20 and pushing downward on the raised portion 13. The ledge 16 must slide past the second ledge 30 and the frictional fit of the raised member 29 before exiting through the opening 26 of the sleeve 20. A new shaker 10 may then be installed.

The preferred embodiment decorative tubular sleeve 20 and the sealed refill cartridge shaker 10 that fits within the sleeve 20 provide cartridge loading of a condiment 37 rather than pouring the condiment into a dispenser. In other words, instead of opening a dispenser to refill it with product, a sealed cartridge shaker 10 containing condiment 37 is used as the refill product. No pouring of product is required to refill the product. The sealed refill cartridge, shaker 10, simply snaps into place within the sleeve 20, and when the product is empty, the empty shaker 10 is discarded and replaced with a full shaker 10. The sealed cartridge shaker 10 provides protection against tampering, contamination, or adulteration and is disposable and replaceable. The shaker 10 is sonically welded closed to provide maximum tamper resistance, safety, and security. In addition, hazard analysis and critical control points are used during the filling process to protect against possible contamination of the product. The shaker 10 is disguised with the sleeve 20 to appear as a refillable and reusable dispenser thereby providing a more attractive appearance. The sleeve 20 can be easily disengaged from the shaker 10 to clean the components without contaminating the condiment.

The preferred one piece construction of the sleeve 20 having an opening 26 in the bottom portion 25 allows for easy determination of condiment level in the shaker 10 as the preferred end portion 15 is clear. The preferred one piece construction of the sleeve 20 also allows for quick release of the shaker 10. The shaker 10 is preferably a replaceable, disposable condiment cartridge that is easily inserted into a sleeve 20. The sleeve 20 is preferably reusable and not disposable. However, if it is desired to change the appearance of the condiment shakers 10, different sleeves 20 may be used. For example, the sleeves 20 may be changed for various occasions such as holidays or sporting events. The sleeve 20 may be used for advertising, coordinating, decorating, etc. Custom colors and/or finishes, company names and/or logos, and distinctive shapes may be used for the sleeve 20. The sleeve 20 may be customized in any manner well known in the art.

Figure 4:
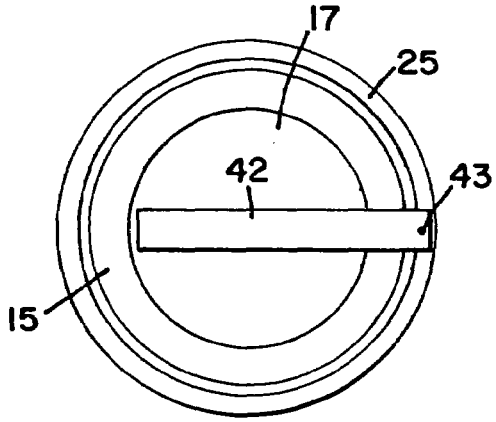
FIG. 4 is a bottom view of another embodiment condiment dispensing assembly.
Figure 5:
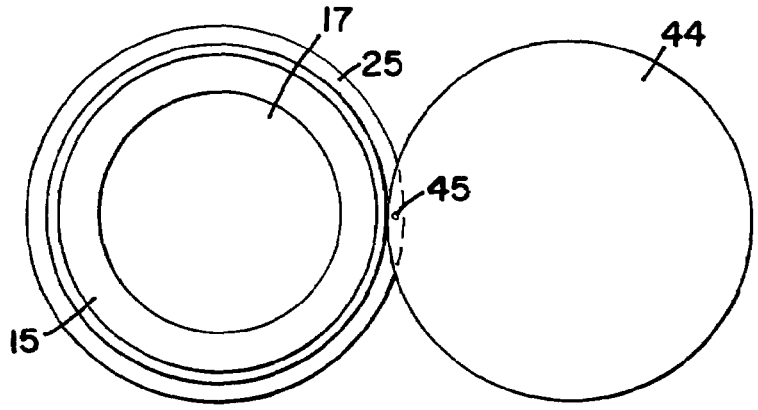
FIG. 5 is a bottom view of another embodiment condiment dispensing assembly.

Rather than utilizing a snap-fit arrangement between the shaker 10 and the sleeve 20, the bottom portion 25 of the sleeve 20 may include any number of securing members. For example, a frictional fit may be used to support the shaker 10 within the sleeve 20. Also, a bar 42 or a disk 44 may be pivoted about a pin 43 or 45, respectively, which operatively connects the bar 42 or disk 44 to the bottom portion 25, to support the end portion 15 or bottom 17 of the shaker 10 within the sleeve 20. These alternative embodiments are shown in FIGS. 4 and 5. In addition, although a one piece construction is preferred, a two piece construction could be used. The sleeve itself could be two pieces that mate to contain the shaker. For example, a cap member such as a plug or a threaded cap could be used. A plug could be inserted into the bottom of the sleeve or a cap having a threaded portion configured and arranged to mate with a threaded portion in the bottom of the sleeve may be used to support the shaker within the sleeve. These examples are not exhaustive, and it is recognized that other suitable constructions are also within the scope of the invention.

In addition to using a disposable shaker for dry condiments, it is recognized that the present invention may also be used with dispensers for liquid condiments such as cream, syrup, etc. contained in either a rigid or a flexible cartridge that may be inserted into a decorative sleeve. The liquid condiment could be dispensed using mechanical or pneumatic expulsion devices. If a rigid cartridge is used, it could snap-fit into the sleeve as the shaker 10 snap-fits within the sleeve 20. If a flexible cartridge is used, it could include a relatively rigid top portion that would snap-fit into a top portion of the sleeve similar to how the shaker 10 snap-fits within the sleeve 20 but proximate the top rather than proximate the bottom. The flexible bottom portion of the cartridge could be suspended from the top portion within the cavity of the sleeve, and the sleeve would provide the support for standing upright on a surface.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A sleeve for use with a disposable, tamper-resistant condiment shaker, the condiment shaker including a top, a wall portion, and an end portion, the wall portion having a first end and a second end, the top being operatively connected to and enclosing the first end, the end portion being operatively connected to and enclosing the second end, the end portion including a ledge proximate the wall portion, the wall portion interconnecting and being integral with the top and the end portion thereby preventing the condiment shaker from being opened, comprising:

a) a top portion including a first opening, said first opening being configured and arranged to provide access to at least a portion of the top of the condiment shaker;

b) a bottom portion including a second opening through which the condiment shaker may be inserted;

c) an intermediate portion interconnecting said top portion and said bottom portion, said intermediate portion including an inner surface, said inner surface including a raised member proximate said bottom portion, said intermediate portion being configured and arranged to house the condiment shaker; and d) a cavity formed by said top portion, said bottom portion, and said intermediate portion, said first opening and said second opening providing access to said cavity, said cavity being configured and arranged to receive the condiment shaker, wherein the top of the condiment shaker is inserted into said second opening, the condiment shaker is pushed through said second opening into said cavity, the ledge is slid past said raised member thereby providing a snap-fit between the condiment shaker and the sleeve, said first opening providing access to at least a portion of the top of the condiment shaker.

2. The sleeve of claim 1, further comprising a raised portion on the top of the condiment shaker, said first opening having a first size and said raised portion having a second size, said second size being smaller than said first size, wherein said raised portion is configured and arranged to extend into said first opening.

3. The sleeve of claim 1, further comprising a label operatively connected to said intermediate portion.

4. The sleeve of claim 1, wherein said top portion, said bottom portion, and said intermediate portion are an integral unit.

5. The sleeve of claim 4, wherein said integral unit is made of metal.

6. The sleeve of claim 4, wherein said integral unit is made of plastic.

7. A condiment dispensing assembly, comprising:

a) a shaker including a top, a wall portion, and an end portion, said wall portion having a first end and a second end, said top being operatively connected to and enclosing said first end, said end portion being operatively connected to and enclosing said second end, said wall portion interconnecting and being integral with said top and said end portion thereby preventing said shaker from being opened and being tamper-resistant; and b) a sleeve including a top portion, a bottom portion, an intermediate portion, a cavity, and a securing member, said top portion including a first opening, said first opening being configured and arranged to provide access to at least a portion of said top of said condiment shaker, said bottom portion including a second opening through which said condiment shaker is inserted, said intermediate portion interconnecting said top portion and said bottom portion and being configured and arranged to house said shaker, said cavity formed by said top portion, said bottom portion, and said intermediate portion, said first opening and said second opening providing access to said cavity, said cavity being configured and arranged to receive said shaker, said securing member being operatively connected to said intermediate portion, wherein said top of said shaker is inserted into said second opening, said shaker is pushed through said second opening into said cavity, said securing member supports said shaker within said cavity of said sleeve, said first opening providing access to said at least a portion of said top of said condiment shaker.

8. The condiment dispensing assembly of claim 7, further comprising:

a) a ledge on said end portion proximate said wall portion; and b) an inner surface of said intermediate portion, said securing member being a raised member on said inner surface proximate said bottom portion, said raised member being at a height proximate a height of said ledge and providing a snap-fit with said ledge of said shaker.

9. The condiment dispensing assembly of claim 7, wherein said securing member is operatively connected to said bottom portion of said sleeve.

10. The condiment dispensing assembly of claim 9, wherein said securing member is a bar operatively connected to said bottom portion on one side with a pin, said bar being pivotable about said pin, wherein said bar supports said shaker within said cavity when pivoted into a position proximate said second opening.

11. The condiment dispensing assembly of claim 7, wherein said securing member is a cap member configured and arranged to operatively connect to said bottom portion of said sleeve to support said shaker within said cavity.

12. The condiment dispensing assembly of claim 7, further comprising a raised portion on said top of said shaker, said first opening of said sleeve having a first size and said raised portion of said shaker having a second size, said second size being smaller than said first size, wherein said raised portion is configured and arranged to extend into said first opening.

13. The condiment dispensing assembly of claim 7, further comprising a second cavity formed by said top, said wall portion, and said end portion of said shaker and a condiment contained within said second cavity.

14. The condiment dispensing assembly of claim 13, wherein said condiment is salt.

15. The condiment dispensing assembly of claim 13, wherein said condiment is pepper.

16. A method of using a sleeve to decorate a condiment shaker, comprising:

a) obtaining a disposable, tamper-resistant condiment shaker containing a condiment, the condiment shaker including a top, a wall portion, and an end portion forming a first cavity, the condiment being contained within the first cavity, the wall portion having a first end and a second end, the top being operatively connected to and enclosing the first end, the end portion being operatively connected to and enclosing the second end, the end portion including a ledge proximate the wall portion, the wall portion interconnecting and being integral with the top and the end portion thereby preventing the condiment shaker from being opened;

b) obtaining a sleeve including a top portion, a bottom portion, an intermediate portion, and a second cavity, the top portion including a first opening, the first opening being configured and arranged to provide access to at least a portion of the top of the condiment shaker, the bottom portion including a second opening through which the condiment shaker may be inserted, the intermediate portion interconnecting the top portion and the bottom portion and including an inner surface, the inner surface including a raised member proximate the bottom portion, the intermediate portion being configured and arranged to house the condiment shaker, the second cavity formed by the top portion, the bottom portion, and the intermediate portion, the first opening and the second opening providing access to the second cavity, the second cavity being configured and arranged to receive the condiment shaker;

c) inserting the top of the condiment shaker into the second opening; and d) pushing the condiment shaker through the second opening into the second cavity, wherein the ledge is slid past the raised member thereby providing a snap-fit between the condiment shaker and the sleeve, the first opening providing access to the at least a portion of the top of the condiment shaker.

17. The method of claim 16, further comprising:

a) dispensing substantially all of the condiment from the condiment shaker thereby rendering an empty condiment shaker;

b) removing the empty condiment shaker from the sleeve; and c) inserting a second condiment shaker containing condiment into the sleeve.

* * * * *